United States Patent [19]

Kramer

[11] 4,277,953

[45] Jul. 14, 1981

[54] APPARATUS AND METHOD FOR DISTRIBUTING VOLATILE REFRIGERANT

[76] Inventor: Daniel E. Kramer, 2009 Woodland Dr., Yardley, Pa. 19067

[21] Appl. No.: 34,777

[22] Filed: Apr. 30, 1979

[51] Int. Cl.[3] ..... F25B 5/00

[52] U.S. Cl. ..... 62/117; 62/504; 62/525

[58] Field of Search ..... 62/504, 525, 117; 137/599

[56] References Cited

U.S. PATENT DOCUMENTS

| | | | |
|---|---|---|---|
| 2,148,509 | 2/1939 | Shafer | 137/599 |
| 2,158,716 | 5/1939 | Bergdoll | 137/599 |
| 2,332,981 | 10/1943 | Anderson | 62/504 |
| 2,669,099 | 2/1954 | Malkoff | 62/426 |
| 2,785,540 | 3/1957 | Biehn | 62/513 |
| 2,813,700 | 11/1957 | Schenck, Jr. | 137/599 |
| 3,099,140 | 7/1963 | Leimbach | 62/197 |
| 3,120,743 | 2/1964 | Wilson | 62/504 |
| 3,541,801 | 11/1970 | Marchal et al. | 62/467 |
| 3,757,530 | 9/1973 | Doyle et al. | 62/117 |
| 3,866,439 | 2/1975 | Bussjager et al. | 62/504 |
| 3,977,205 | 8/1976 | Dreisziger et al. | 62/117 |

*Primary Examiner*—Ronald C. Capossela
*Attorney, Agent, or Firm*—Daniel E. Kramer

[57] ABSTRACT

A distributor for volatile refrigerant having a single inlet and many outlets and designed to distribute refrigerant substantially uniformly to each outlet, has its outlets manifolded together in groups to provide equal refrigerant distribution to a few relatively large loads or unequal distribution to a few relatively large loads according to a predetermined ratio, the ratio of the refrigerant distribution to the various loads being predetermined by the ratios of the numbers of outlets that are selected to serve those loads.

18 Claims, 17 Drawing Figures

FIGURE 1A
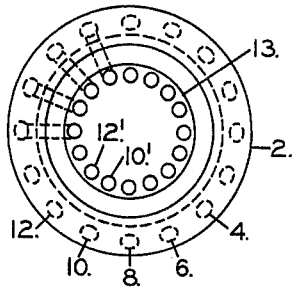
FIGURE 1B
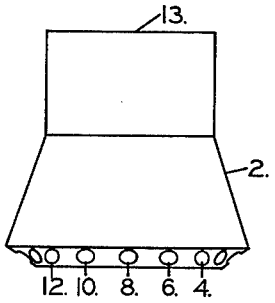
FIGURE 1C
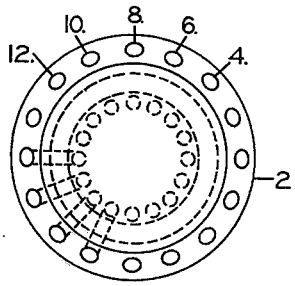
FIGURE 1 (ASSOCIATED ART)
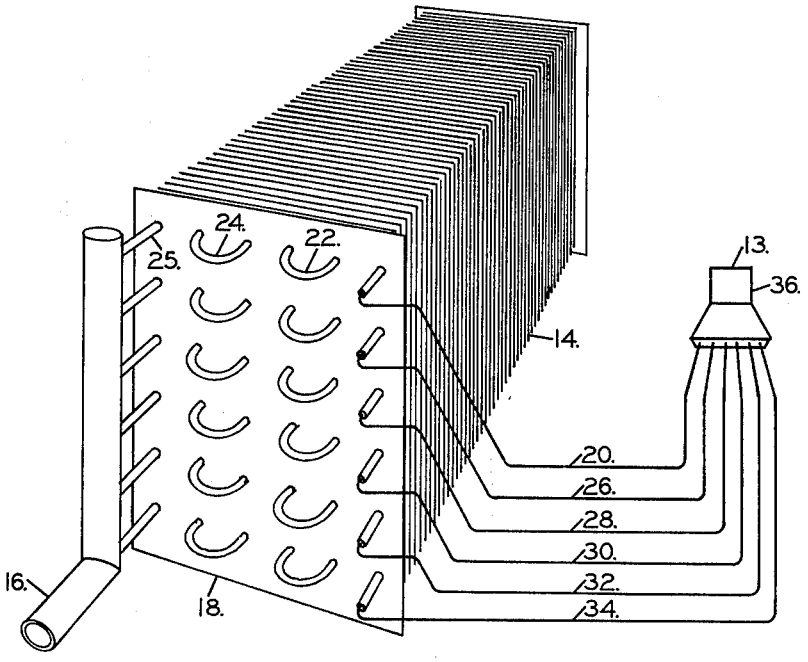
FIGURE 2 (ASSOCIATED ART)

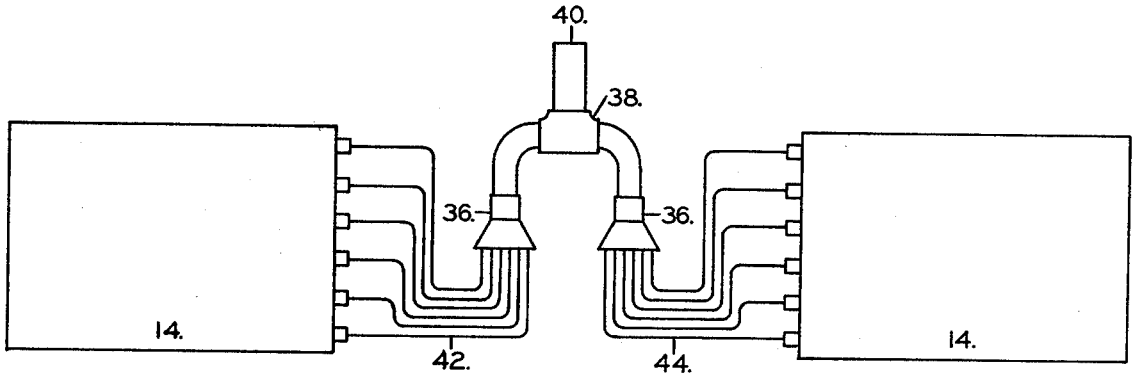
FIGURE 3 (ASSOCIATED ART)
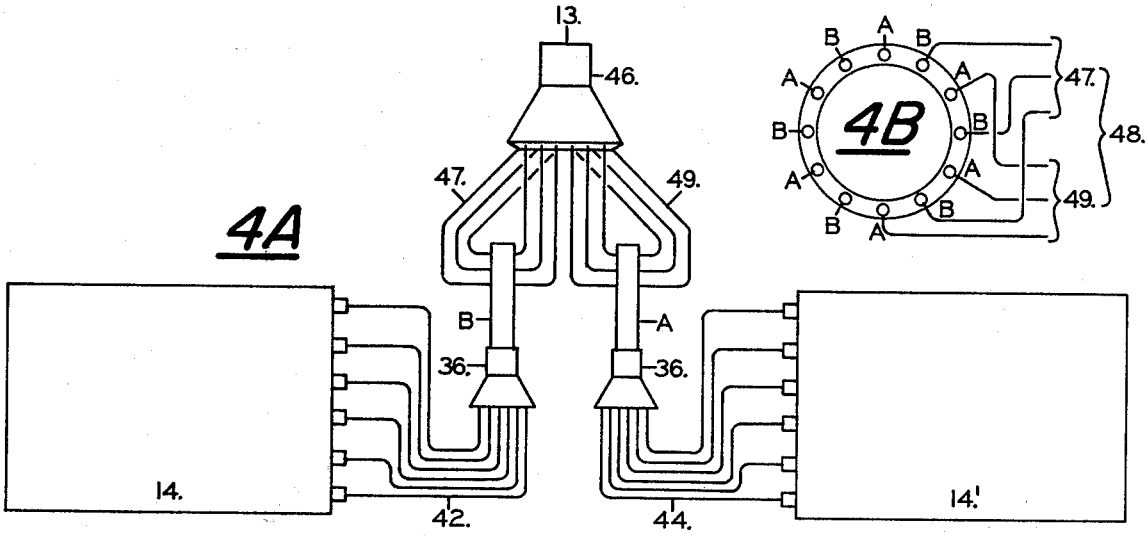
FIGURE 4
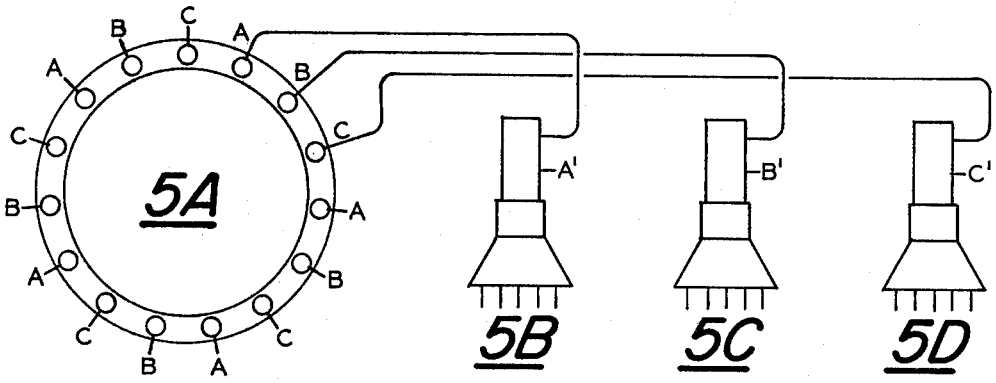
FIGURE 5

APPARATUS AND METHOD FOR DISTRIBUTING VOLATILE REFRIGERANT

BACKGROUND OF THE INVENTION

1. Field of the Invention

The invention relates to the field of refrigeration and air conditioning, and, within that field, to the distribution of partially expanded volatile refrigerant to one or more refrigeration evaporators.

2. Discussion of the Known Associated Art:

Refrigerant distributors having one inlet and n outlets (n between 2 and 30) are well known. Distributor manufacturers such as Sporlan Co. of St. Louis or Alco Co. of St. Louis claim that their distributors are so designed that each outlet receives substantially the same quantity of refrigerant as any other outlet and therefore it is intended that the outlets be connected to substantially equal loads. The inventor has never experienced and is not aware of refrigerant distributors or refrigerant distributing means which are capable of distributing to a relatively small number of relatively large loads precisely equally or unequally with a predetermined ratio.

BRIEF SUMMARY OF THE INVENTION

My invention achieves the object of distributing refrigerant in a predetermined ratio to a relatively small number of relatively large loads by employing a multi-pass distributor, such as is offered for sale by both Sporlan Company and by Alco Company, both of St. Louis. These standard multi-pass distributors have a single inlet—for instance, $1\frac{5}{8}''$ (41.28 mm) and many outlets, for instance 24, each $\frac{3}{8}''$ (8.4 mm) intended for connection to 24 substantially identical loads or passes. My invention achieves its object by grouping together the small individual outlets or feeds from the 24 feed commercial distributor so that the number of feeds connected to each load is proportionate to the relationship that that load has to the total load. For instance, a 24-feed distributor, having a design capacity of 48 tons, could be used to feed two loads equally, each having a capacity of 24 tons, by connecting half of the feeds of the distributor to one load and the remaining half of the feeds to the other load. The invention could be used to equally feed three 16-ton loads by using eight of the 24 feeds joined together to feed the first load; a second eight of the 24 feeds joined together to feed the second load; and the remaining eight of the 24 feeds joined together to feed the third load.

Should the designer find that his evaporator most conveniently falls into a construction having two feeds, where one feed requires 75% of the load, and the other only 25%, he can utilize 18 of the 24 feeds of the standard distributor to feed the larger load and the remaining 6 feeds combined together to feed the smaller load, and by this means he will have adjusted the proportion of the refrigerant to each of his two circuits to that which his designs require. Where very large loads must be handled, larger than any existing refrigerant distributor is capable of handling, two or more distributors can be grouped together with their inlets manifolded by an informal distributor and so long as the same proportion of the outlets of each distributor are assigned to each of the loads, the uniformity of distribution to the inlets of the distributors via the informal distribution arrangements need not be predictable or even constant, since each distributor will properly proportion the refrigerant fed to it the refrigeration loads.

This invention, therefore, has the object of utilizing large multi-feed distributors to feed large loads having relatively few passes. The invention has the further object of allowing the designer to predetermine the proportion in which the refrigerant is fed to his several loads. The invention has the further object of facilitating the use of several distributors in parallel to feed a few large loads either equally or with a predetermined distribution ratio.

BRIEF DESCRIPTION OF THE DRAWINGS

FIG. 1, labeled "Associated Art" is a top, side and bottom view of a typical, commercially available, multi-pass distributor having a single large inlet and many small outlets.

FIG. 2, labeled "Associated Art" shows a typical multi-pass evaporator coil using the distributor of FIG. 1 for uniformly distributing refrigerant to each of its passes.

FIG. 3, labeled "Associated Art", shows two equal coils similar to that of FIG. 2, approximately equally fed by an impromptu field-constructed "bull head" distributor.

FIG. 4 has two parts: 4A and 4B. 4A shows the two evaporators of FIG. 3 but with a central distributor arranged to distribute equally to the two coils. FIG. 4B shows a plan view of the distributor and identifies the assignment of the distribution tubes to each evaporator.

FIG. 5 has four parts: 5A, 5B, 5C and 5D. 5B, 5C and 5D represent three substantially equal large refrigeration loads. 5A is a plan view of the distributor showing how the refrigerant feeds are assigned to each load to achieve the desired equal distribution.

FIG. 8C shows a plan view of a distributor and identifies the feed selection for each load so that the refrigerant fed to each will be in the required proportion.

DETAILED DESCRIPTION OF THE INVENTION

Figure 6:
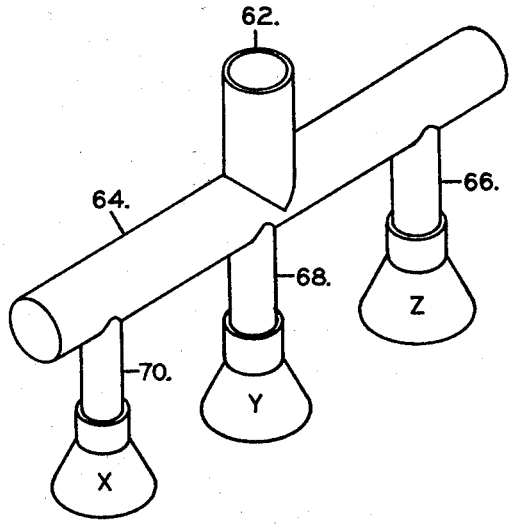
FIG. 6 shows three distributors connected together on the inlet side by an informal manifolding arrangement.

FIG. 1, labeled "Associated Art" shows a typical commercial multi-pass distributor from three views. In FIG. 1B, 2 is the distributor. The inlet 13 connects to a chamber, visible in 1A, into which the inlets of the distributing passages, numbered in part in the three views as 4, 6, 8, 10 and 12, are found. The highly agitated mixture of liquid and vapor, delivered by an expansion valve to the distributor inlet 13, is distributed and divided substantially uniformly to the inlets of all the distributing passages, two of which have been identified as 12' and 10' to correspond with the numbered distributor feeds 10 and 12. The other inlets correspond similarly to the labeled and unlabeled outlets. The outlet feeds 4, 6, 8, 10, 12 and the unnumbered remainder are all bored to some standard size, typically $\frac{1}{4}''$, 5/16" or $\frac{3}{8}''$ (6.35, 7.94, 9.53 mm).

FIG. 2, labeled "Associated Art" illustrates the use of the distributor of FIG. 1 to distribute substantially equal quantities of refrigerant from an inlet 13 through six distributor tubes labeled 20, 26, 28, 30, 32, and 34, to the corresponding pass inlets on the evaporator 18. Evaporator 18 is constructed with 6 passes. The uppermost pass, fed by distributor tube 20, communicates from its inlet with the return bend 22 to tubes which traverse the evaporator coil connected together at opposite ends by a return bend like that #22 but not shown. In sequence, the refrigerant flows through return bends 22, 24, and into the outlet manifold 16 via the outlet connection 25. The remaining passes, fed by distributor tubes 26, 28, 30, 32 and 34, are all connected in exactly similar ways and the refrigerant fed by these distributor tubes into the coil is evaporated to dryness and the vapor resulting therefrom enters suction manifold 16 along with the vapor from the uppermost pass. The combined vapor from all the passes leaves the manifold 16 and travels to a compressor, not shown, where the refrigerant vapor is compressed and later condensed into a liquid for re-use. The evaporator 18, having finned tubes or being in contact with water to be cooled or frozen, and having a large surface, is the primary heat transferring agent for providing heat to the refrigerant flow stream and evaporating liquid refrigerant to dryness. Distributor 36 and the distributor tubes 20, 26, 28, 30, 32 and 34, though they may be in the fluid path to be cooled, have little surface, are not finned, and therefore contribute relatively little to the total heat transfer taking place between distributor inlet 13 and evaporator outlet 16. The function of the distributor and the distributing tubes is primarily physical and with respect to the total heat transfer taking place in the evaporator these components are substantially adiabatic.

FIG. 3, labeled "Associated Art", shows two coils, each the same as the coil shown in FIG. 2, fed by an impromptu distributor 38, also known as a bullhead distributor. Where substantially equal distribution between two equal coils or loads is required, such an impromptu distributor generally provides reasonably satisfactory performance, provided great care is taken to see that the inlet section 40 is satisfactorily long and symmetrically directed into the center of the inlet tee 38.

FIG. 4 shows the same two coils as illustrated in FIG. 3, 14 and 14'. Here, the principle of the invention is utilized to provide precisely equal distribution to main loads A and B. This is achieved by the use of a third primary distributor 46, half 47 of whose outlet feeds 49 are joined together to feed inlet manifold A, feeding the righthand coil 14', the other half 47 of which are joined together to feed inlet manifold B connected to the lefthand evaporator 14. In FIG. 4B, which is a plan view of the outlet feeds of distributor 46, each outlet feed is identified with the letter A or B, indicating the manifold to which its feed is to be connected. These feeds, generally designated as 48, are selected on an alternate basis, each alternate feed 47 being connected to manifold B, and in sequence each other alternate feed 49 being connected to manifold A. In this way, even if there is some maldistribution around the interior of the distributor inlet chamber 13, the repeated sampling of the contents of the distributor inlet chamber 13 allows substantially perfectly equal distribution to the two main loads A and B.

FIG. 5 shows an application where 3 loads, A', B' and C', must be equally fed. There is no rudimentary three-leg distributor similar to the bullhead feed 38 shown in FIG. 3 which can be used to achieve substantially equal distribution to three large loads. In the plan view 5A of the outlet feeds of the distributor, each distributor feed labeled A is connected to the load labeled A'. Each feed labeled B is connected to the load labeled B'. Each feed labeled C is connected to the load labeled C'. Notice the successive alternating sequence whereby every third feed is connected to load A', and in sequence every third feed is connected to load B' and, in turn, every third feed is connected to load C'. Refrigerant flow to any load A', B' or C' constitutes a substream of the main or parent stream entering the distributor of 5A.

Figure 7:
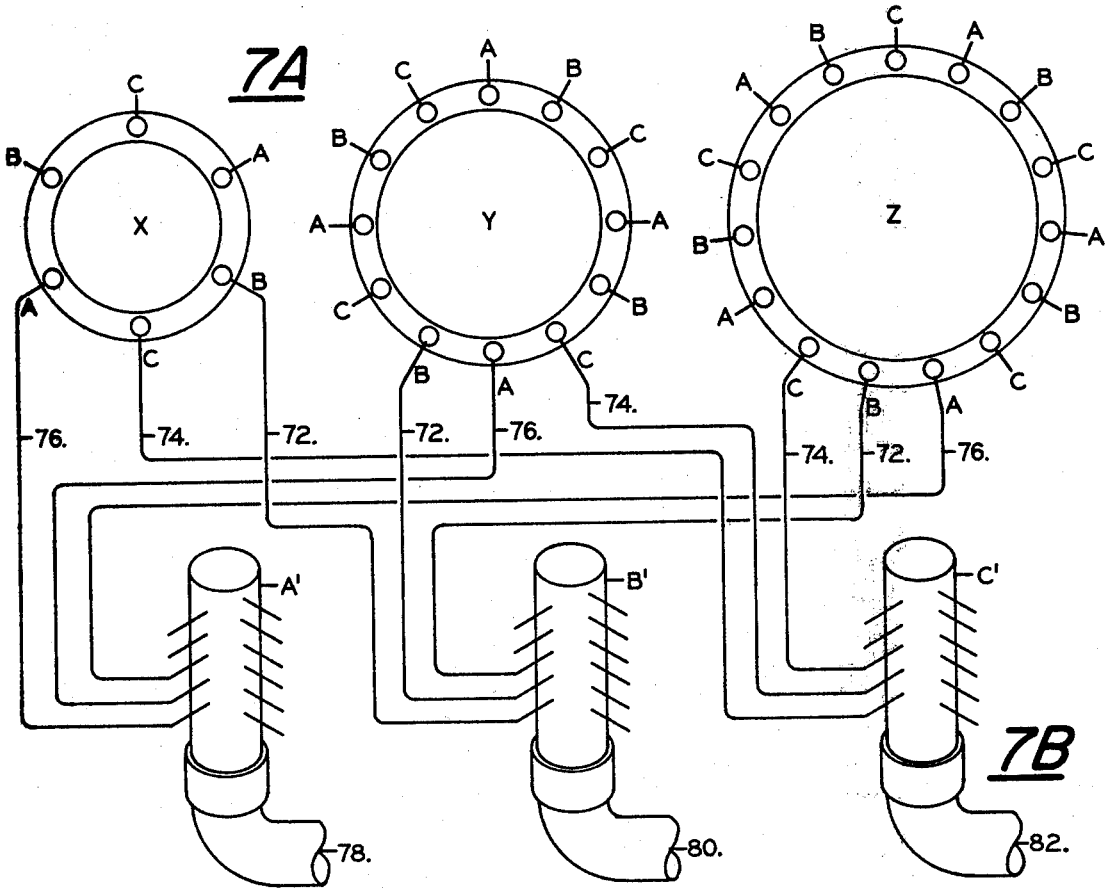
FIG. 7 has two parts: 7A and 7B. 7A shows the plan view of the outlets of the distributors of FIG. 6 and the assignment of the feeds of those distributors to certain loads. 7B shows the three inlet connections for the corresponding loads.

In some cases, it is desirable for the designer to be able to feed equally or in predetermined proportion loads that are larger than can be supplied by any single, available distributor. FIGS. 6, 7A and 7B show an arrangement where the three loads, A', B' and C', of FIG. 7B can be equally fed from three distributors, X, Y and Z, whose inlets are informally manifolded through leads 66, 68 and 70 to inlet manifold 64, which, in turn, is fed from main inlet 62. Inlet manifold 64 is not arranged in any way that would assure uniform distribution between distributors X, Y and Z. However, the same fraction of available distributor feeds from distributor X, from distributor Y and from distributor Z are employed to feed load A'. In turn, the same fraction of the total available distributor leads of distributor X is used to feed load B'. The same fraction of available distributor leads of distributor Y is used to feed load B' and, in turn, of distributor Z is used to feed load B'. In this way, even though the distributors each have different numbers of feeds and themselves may be of substantially different sizes, their capacities can be additive so that distribution to a few very large loads can be precisely made from the number of distributors which are required to supply the required load. In FIG. 7A, distributor X, which has six feeds, has two assigned to load A', two assigned to load B' and two assigned to load C'. Distributor Y, which has twelve feeds, has four feeds assigned to load A', four assigned to load B', and four assigned to load C'.

Distributor Z, which has fifteen feeds, has five assigned to load A', five assigned to load B' and five assigned to load C'. Therefore, in the case of each of the three participating distributors, one-third of the feeds are assigned to load A', one-third to load B', and one-third to load C'. Even if the liquid distribution in the informal inlet manifold 64 changes so that relatively more liquid is supplied to distributor Z at one time and relatively more liquid is supplied to distributor X at another time, the net distribution to each of the loads A, B and C remains equal.

FIG. 7B shows one form of inlet manifold which can be used to accept many feeds for an individual load. In the case of load C', its individual leads 74 are connected respectively to all of the feeds of distributors X, Y and Z of 7A labeled C. The leads 72 for load B' are connected to all of the individual distributor feeds of 7A labeled B. The individual leads of load A', labeled 76, are connected to the feeds labeled A of each of the distributors X, Y and Z of 7A.

In the event the designer decided that the ratio of the loads of A':B':C' was to be 1:2:3, instead of 1:1:1, as above described, load A' would receive only one feed from distributor X, two feeds from distributor Y and two feeds from distributor Z, three of its excess feeds having been blanked off, load B' would receive two feeds from distributor X and four feeds each from distributors Y and Z. Load C' would receive three feeds from distributor X and six feeds each from distributors Y and Z.

Figure 8:
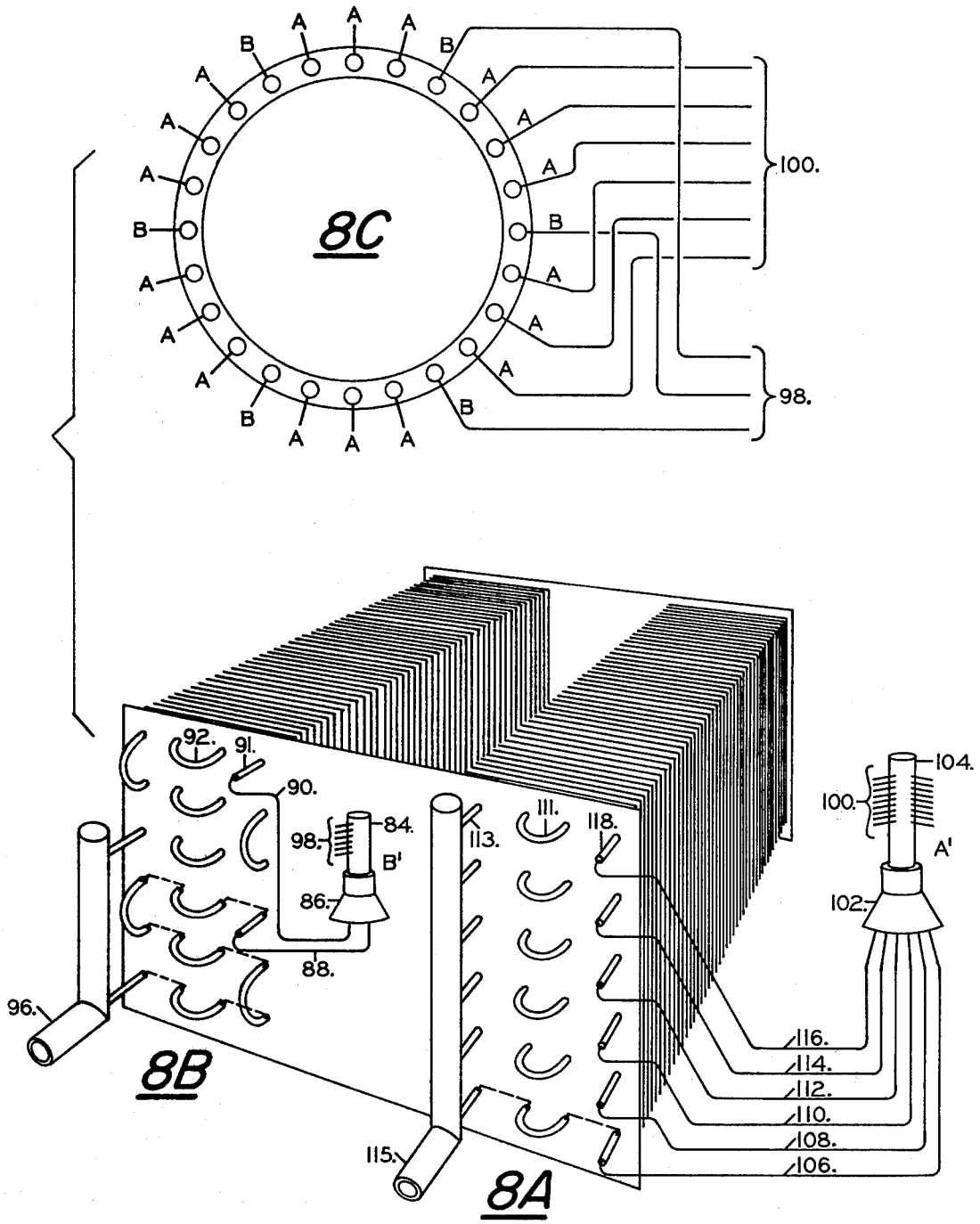
FIG. 8 has three parts: 8A, 8B and 8C. 8A and 8B are two refrigeration evaporators having load requirements of 0.75 and 0.25 of the total.

FIG. 8 shows two coils for the cooling of air located in series in the same air stream. The coil of 8A is in contact with the inlet air and therefore generates 80% of the aggregate capacity of the two coils, 8A and 8B, acting together. Coil 8B, being subject to the air already partially cooled by coil 8A, generates 20% of the aggregate capacity. In the situation where it is desirable to employ one expansion valve to feed both coils, the proportioning of the refrigerant to the individual distributors of each coil can be made through the use of a main distributor 8C, whose distribution plan requires that, of every repeating group of four feeds, three are directed to distributor A via distributor tubes 100 and one directed to distributor B' via distributor tubes 98.

I claim:

1. Conduit means for conveying a first refrigerant flow stream, evaporating means having a refrigerant inlet side and a refrigerant outlet side, flow dividing means positioned entirely between the conduit means and the inlet side of the evaporating means for receiving and for dividing said first refrigerant flow stream into at least two substreams, said flow dividing means comprising: primary distributor means for receiving the first refrigerant flow stream and dividing said first stream into at least three feeder refrigerant flow streams, means for receiving and recombining the feeder streams into at least two substreams.

2. Flow dividing means as in claim 1 where the primary distributor means includes: first distributor means having an inlet and outlets for dividing a flow stream; second distributor means having an inlet and outlets for dividing a flow stream; and third distributor means having an inlet and outlets for dividing a flow stream; and where the inlet of the first distributor means is conduit-connected to receive the larger refrigerant flow stream and to divide said flow stream into parts and substantially unrestricted conduits for simultaneously delivering said parts to the inlets of the second and third distributor means; and where flow from the outlets of the second and third distributor means constitute the feeder streams.

3. Flow dividing means as in claims 1 or 2 where the flow rates in all the feeder streams are substantially equal.

4. Flow dividing means as in claim 2 where one of the means for receiving and recombining the feeder streams to form a substream receives a fraction of the feeder streams from the second distributor means and a substantially similar fraction of the feeder streams from the third distributor means.

5. Flow dividing means as in claims 1 or 2 where the number of feeder streams combined to form each substream is the same.

6. Flow dividing means as in claims 1 or 2 where the number of feeder streams combined to form a first substream is fewer than the number of feeder streams combined to feed a second substream.

7. Partitioning means for forming a parent refrigerant flow stream into substreams; where the partitioning means consist of substantially adiabatic apparatus, said apparatus comprising a distributor having inlet means for receiving the parent stream and outlet means for discharging at least three feeder refrigerant flow streams, and means for recombining at least two of the feeder streams into a substream.

8. Improved apparatus for dividing a parent flow stream into substreams prior to flow into a refrigeration evaporator comprising:

(a) first distributor means for dividing the parent stream into parts;

(b) second distributor means for receiving a part and dividing said part into a first group of feeder streams;

(c) third distributor means for receiving a part and dividing said part into a second group of feeder streams;

(d) means for receiving the parts from first distributor means and substantially unrestricted means for simultaneously conveying said parts to the second and third distributor means;

(e) at least two recombining means for receiving feeder streams and emitting substreams.

9. Improved apparatus as in claim 8 where each recombining means receives substantially similar portions of the feeder streams constituting each group.

10. The method of dividing a refrigerant flow stream into substreams comprising the following steps all conducted under substantially adiabatic conditions:

(a) receiving a parent flow stream (b) dividing the parent flow stream into feeds (c) recombining the feeds into at least two substreams.

11. The method of claim 10 where the recombining step includes the step of providing a substantially similar number of feeds for each substream.

12. The method of dividing a refrigerant flow stream into substreams comprising the following steps all conducted under substantially adiabatic conditions:

(a) receiving a refrigerant flow stream;

(b) dividing the flow stream into parts;

(c) simultaneously conveying each part to a divider through a substantially unrestricted conduit;

(d) dividing each part into a group of feeds;

(e) combining feeds to form at least two substreams.

13. A method as in claim 12 where the step of combining feeds to form substreams includes the step of selecting for a substream substantially similar fractions of the number of feeds in each group.

14. Flow dividing means for dividing a larger refrigerant flow stream into at least two substreams comprising primary distributor means for receiving the larger refrigerant flow stream and dividing said larger stream into at least three feeder refrigerant flow streams, means for receiving and recombining the feeder streams into at least two substreams where the primary distributor means includes: first distributor means having an inlet and outlets for dividing a flow stream; second distributor means having an inlet and outlets for dividing a flow stream; and third distributor means having an inlet and outlets for dividing a flow stream; and where the inlet of the first distributor means is conduit-connected to receive the larger refrigerant flow stream and to divide said flow stream into parts and substantially unrestricted conduits for simultaneously delivering said parts to the inlets of the second and third distributor means; and where flow from the outlets of the second and third distributor means constitute the feeder streams.

15. Flow dividing means as in claim 14 where the flow rates in all the feeder streams are substantially equal.

16. Flow dividing means as in claim 14 where one of the means for receiving and recombining the feeder streams to form a substream receives a fraction of the feeder streams from the second distributor means and a substantially similar fraction of the feeder streams from the third distributor means.

17. Flow dividing means as in claim 14 where the number of feeder streams combined to form each substream is the same.

18. Flow dividing means as in claim 14 where the number of feeder streams combined to form a first substream is fewer than the number of feeder streams combined to feed a second substream.

* * * * *